US011662175B1

(12) United States Patent
Dustin et al.

(10) Patent No.: US 11,662,175 B1
(45) Date of Patent: May 30, 2023

(54) BASEPLATE FOR A RIFLE RECOIL ASSEMBLY

(71) Applicant: Sig Sauer, Inc., Newington, NH (US)

(72) Inventors: Bryan Charles Dustin, Strafford, NH (US); Samuel Beck, Atkinson, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/564,880

(22) Filed: Dec. 29, 2021

(51) Int. Cl.

| | |
|---|---|
| ***F41A 3/86*** | (2006.01) |
| ***F41A 3/72*** | (2006.01) |
| ***F41A 3/82*** | (2006.01) |
| ***F41C 23/08*** | (2006.01) |

(52) U.S. Cl.
CPC ..... *F41C 23/08* (2013.01); *F41A 3/72* (2013.01); *F41A 3/82* (2013.01); *F41A 3/86* (2013.01)

(58) Field of Classification Search
CPC ..... F41A 3/72; F41A 3/78; F41A 3/80; F41A 3/82; F41A 3/84; F41A 3/86; F41A 3/66; F41C 23/00–22
See application file for complete search history.

(56) References Cited

U.S. PATENT DOCUMENTS 1,710,638 A * 4/1929 Garr ..... F41A 3/82 89/149
3,225,653 A * 12/1965 Packard ..... F41A 3/72 89/1.4
4,098,016 A * 7/1978 Foote ..... F41A 21/10 42/16
7,240,600 B1 7/2007 Bordson
7,832,333 B2 11/2010 Shi et al.
7,900,546 B2 3/2011 Bordson
8,104,393 B2 1/2012 Kincel
8,336,436 B2 12/2012 Kincel
8,356,537 B2 1/2013 Kincel
8,464,453 B1 * 6/2013 Ubl ..... F41A 3/68 42/15
8,955,422 B1 * 2/2015 Schumacher ..... F41A 25/10 89/193
8,960,066 B2 2/2015 Gomez
9,377,258 B2 6/2016 Gomez
9,846,003 B2 12/2017 Hwang
10,323,891 B1 * 6/2019 Zheng ..... F41A 3/84
(Continued)

FOREIGN PATENT DOCUMENTS

WO WO-2021118479 A1 * 6/2021

*Primary Examiner* — Gabriel J. Klein
(74) *Attorney, Agent, or Firm* — Finch & Maloney PLLC

(57) ABSTRACT

A recoil assembly for a rifle includes a baseplate comprising a baseplate body extending longitudinally along a central axis from a proximal end to a distal end, the baseplate body defining an opening extending along the central axis and configured to receive an end of a recoil spring guide rod. A latch plate extends up from the top surface of the baseplate body, the latch plate defining a charging handle opening a catch surface for a charging handle latch. In use, the recoil baseplate can be received in an aperture defined in the upper receiver of a rifle, where one or more recoil spring guide rods are received in the opening in the baseplate body. A charging handle can be slidably received through the charging handle opening and charging handle aperture of the upper receiver.

20 Claims, 15 Drawing Sheets

(56) References Cited

U.S. PATENT DOCUMENTS

| | | | | |
|---|---|---|---|---|
| 2012/0204713 | A1* | 8/2012 | Patel | F41A 3/66<br>42/2 |
| 2013/0118343 | A1* | 5/2013 | Hirt | F41A 19/44<br>89/149 |
| 2018/0010879 | A1* | 1/2018 | Bonine | F41A 3/84 |
| 2018/0164057 | A1* | 6/2018 | Steimke | F41A 3/82 |
| 2018/0224227 | A1* | 8/2018 | Durham, III | F41A 3/26 |
| 2018/0274870 | A1* | 9/2018 | Law | F41A 3/82 |
| 2022/0187036 | A1* | 6/2022 | Mossman | F41A 3/66 |

* cited by examiner

BASEPLATE FOR A RIFLE RECOIL ASSEMBLY

TECHNICAL FIELD

The present disclosure generally relates to firearms components and accessories. Specifically, the present disclosure relates to a recoil baseplate and firearms assemblies including the same.

BACKGROUND

Contemporary small arms use combustion gases to cycle the action and ready the firearm for the next shot. In direct impingement systems and gas piston systems, both of which can be found on rifles based on the AR-15 platform, pressurized gases in the barrel are directed to a gas tube or piston to drive the bolt-carrier assembly rearward and cycle the action. In the case of a direct impingement system, gases travel through the barrel, into a gas block, and through a gas tube to push the bolt carrier group rearward with sufficient force to cycle the action. In the case of a gas piston system, the gas tube is replaced by a piston arranged so that pressurized gases enter a gas block from the barrel, and in turn actuate the piston to move the bolt rearward and cycle the action.

The recoil assembly includes one or more springs that counter the rearward forces from pressurized gases and return the bolt forward to chamber a round. One example is the buffer spring in an AR-type rifle. The buffer spring is housed in a buffer tube that extends rearward from the receiver and into the stock. As the bolt/carrier group travels rearward, the buffer spring compresses, providing the force to return the bolt and carrier forward, stripping a round from the top of the magazine, and chambering the round to ready the gun to fire again. Some short-barreled rifles and submachine guns do not have a buffer tube, and instead replace the buffer spring with a recoil spring or buffer piston oriented with one end at the rear portion of the receiver.

Figure 1A:
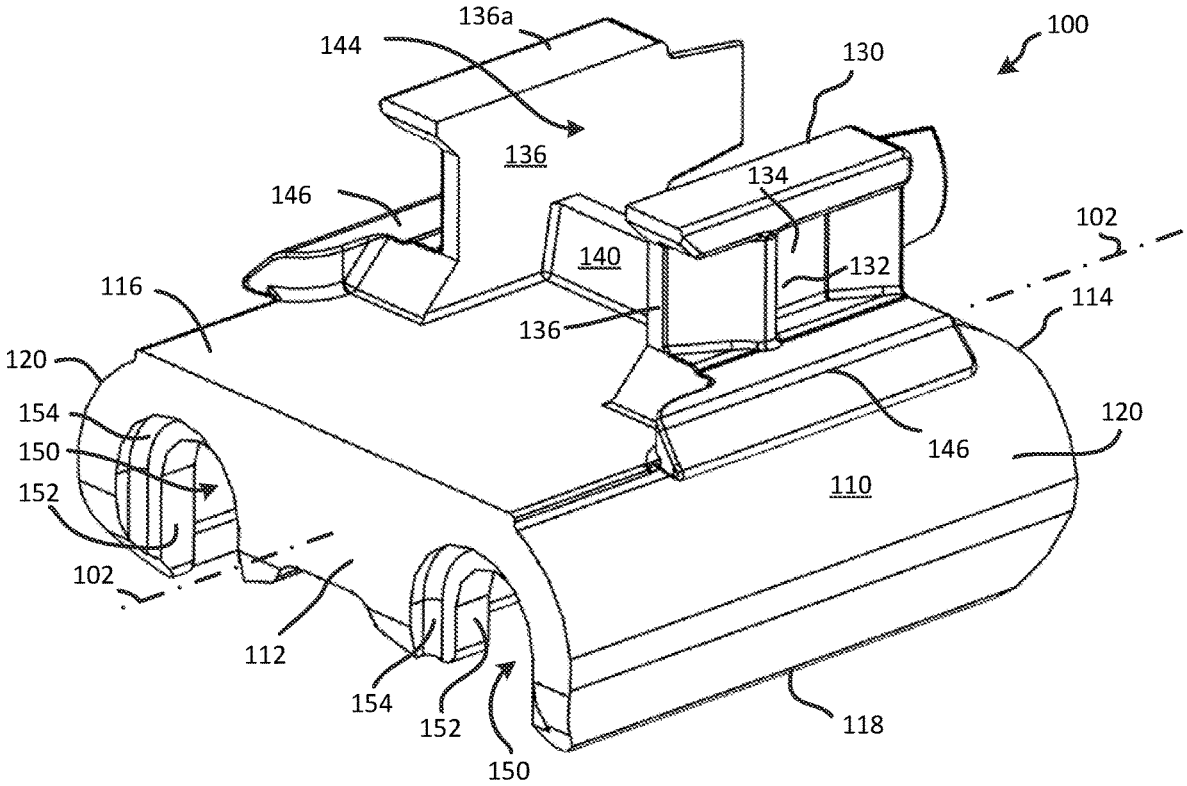
FIG. 1A is a rear perspective view of a baseplate for a recoil assembly, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a baseplate for a rifle recoil assembly and a recoil assembly that includes the baseplate. In accordance with one embodiment, the baseplate houses and retains proximal ends of the recoil guide rods and recoil springs. The baseplate also supports the charging handle and provides a catch surface to retain the charging handle in the forward and latched position. The baseplate can be received in a recess defined in the upper receiver. In one example embodiment, the baseplate includes a baseplate body that defines openings to receive the recoil springs and guide rods. A latch plate on top of the body defines an opening to receive the charging handle body and defines a catch surface for the latch of the charging handle. For example, laterally spaced-apart walls extend up from the top surface of the baseplate and define a catch surface in an outside face of one or both walls. Between the walls is a channel that receives the charging handle body during reciprocating movement forward and backward. The recoil baseplate can be part of a rifle recoil assembly includes the baseplate, one or more recoil springs with corresponding spring guide rod(s), a bolt/carrier assembly, and a recoil connector that connects the recoil springs to the bolt/carrier assembly. The baseplate and recoil assembly can be part of a rifle upper receiver assembly or complete firearm, in accordance with some embodiments. Numerous variations and embodiments will be apparent in light of the present disclosure.

General Overview

A traditional charging handle can be retained in the upper receiver by latching to a catch surface on the side of the upper receiver. This latch approach requires machining the side of the upper receiver to define a recess and catch surface for engagement with the latch hook of the charging handle. However, the sidewall of the upper receiver is typically made of aluminum of relatively small thickness. As such, the sidewall lacks sufficient material to define a robust catch surface and machining the catch surface is a non-trivial task. Thus, it would be desirable to have an alternative to latching to the side of the upper receiver.

In addition, existing recoil assemblies separate the functions of charging handle retention and control from the functions of retaining the recoil springs and guide rods. For example, a traditional charging handle is slidably received in the upper receiver and is retained by latching to the side of the upper receiver, as noted above. The recoil springs extend between bolt/carrier assembly and the upper, rear portion of the lower receiver, or to a buffer tube in the lower receiver. In one such design, the upper, rear end of the lower receiver is milled to receive an insert of the recoil assembly, such as a receptacle for the recoil springs. However, such a design has high machining costs, the corresponding insert utilizes a different latch mechanism that requires a compatible charging handle, and installing the recoil assembly in the receiver is less intuitive because components of the recoil assembly are distributed between the upper and lower receivers. Thus, a need exists for alternatives to existing approaches to a rifle recoil assembly.

A baseplate in accordance with the present disclosure can eliminate the need for fine or complicated receiver machining. It also can enable the charging handle and recoil assembly (e.g., bolt carrier, bolt, recoil spring assembly) to be assembled separately from the upper receiver and then dropped into the upper receiver as a single functional group, simplifying installation. For example, the baseplate is installed in the upper receiver in an opening located above the bolt aperture, with recoil springs extending from the baseplate to a recoil connector that is coupled to the bolt. A recoil baseplate and recoil assembly as variously described herein can be used with a variety of automatic and semiautomatic firearms, including but not limited to Sig Sauer's MCX, MPX, and M400 rifles, to name a few examples.

As discussed herein, terms referencing direction, such as upward, downward, vertical, horizontal, top, bottom, left, right, front, back, etc., are used for convenience to describe embodiments of a firearm, its components, or component groups when the firearm is oriented in a traditional firing position with the barrel extending horizontally from the user and the stock retained against the user's shoulder. Embodiments of the present disclosure are not limited by these directional references and it is contemplated that a firearm and its components or component groups discussed in accordance with the present disclosure could be used in any orientation.

Also, it should be noted that, while generally referred to herein as a baseplate for consistency and ease of understanding the present disclosure, the disclosed baseplate is not limited to that specific terminology, and the baseplate alternatively can be referred to, for example, as a recoil spring receptacle, a base, or other term. Further, a baseplate as variously disclosed herein is generally configured to receive an end of one or more recoil spring guide rods and to stabilize the end of the guide rod(s) during use of the firearm, but is not limited to any particular structure or geometry. Numerous configurations will be apparent in light of this disclosure.

Example Embodiments

Figure 1B:
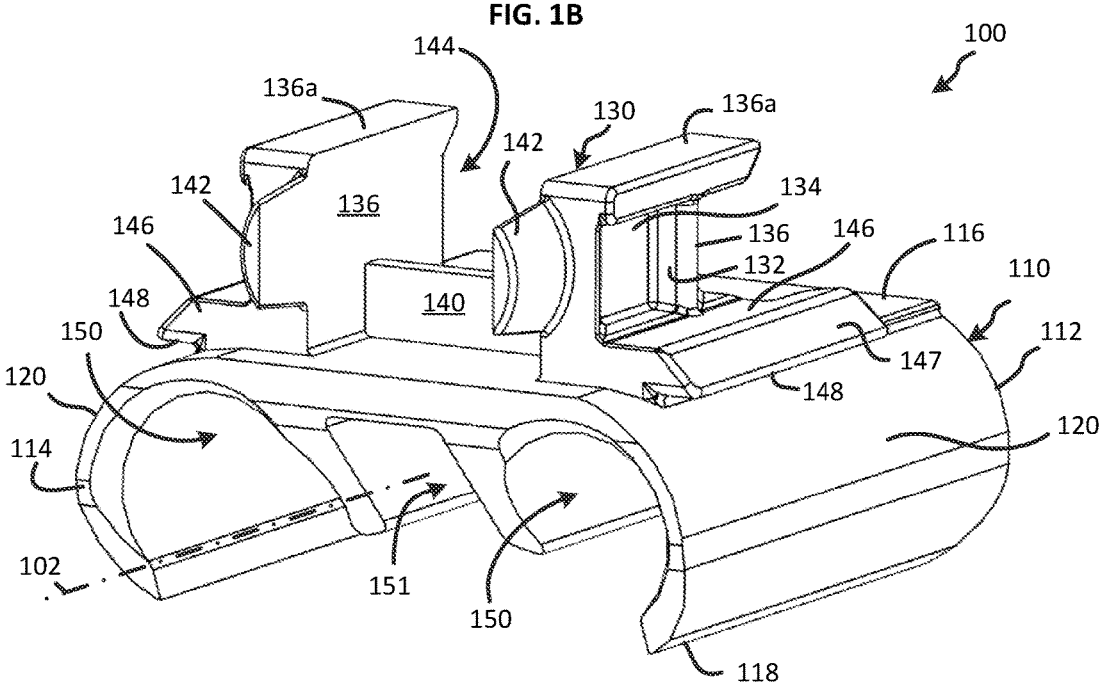
FIG. 1B is a front perspective view of the baseplate of FIG. 1A, in accordance with an embodiment of the present disclosure.
Figure 1C:
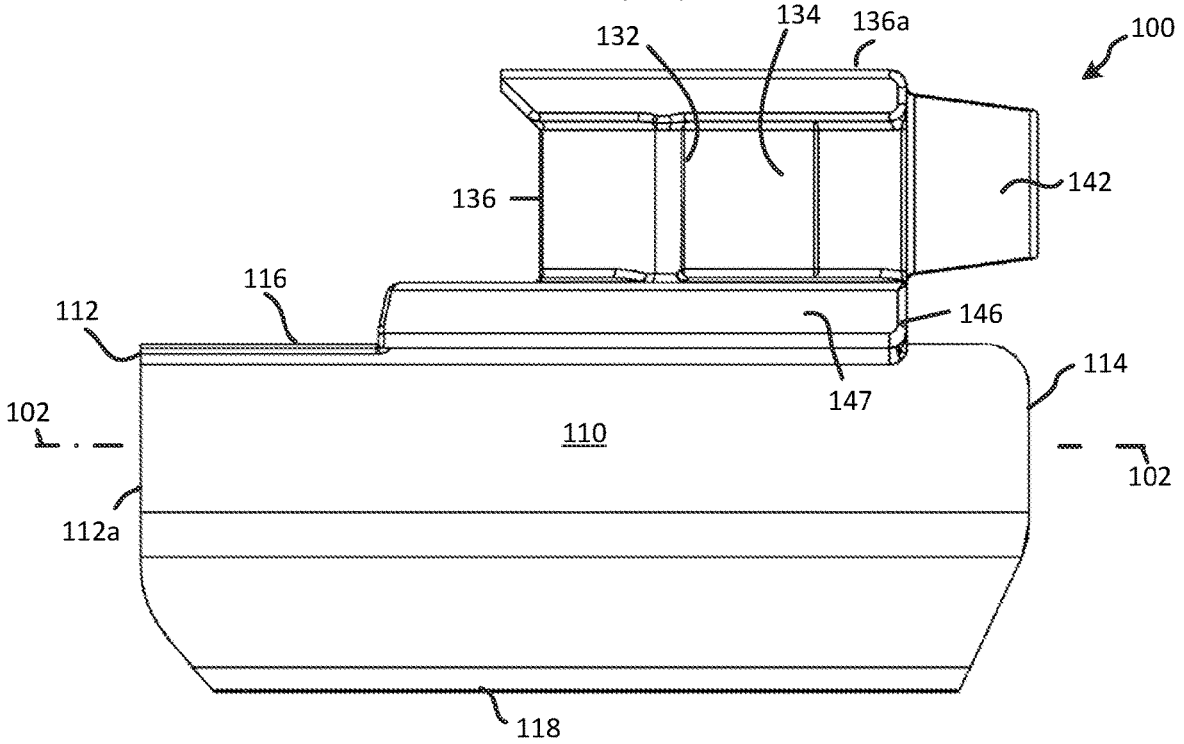
FIG. 1C is a side view of the baseplate of FIG. 1A, in accordance with an embodiment of the present disclosure.
Figure 1D:
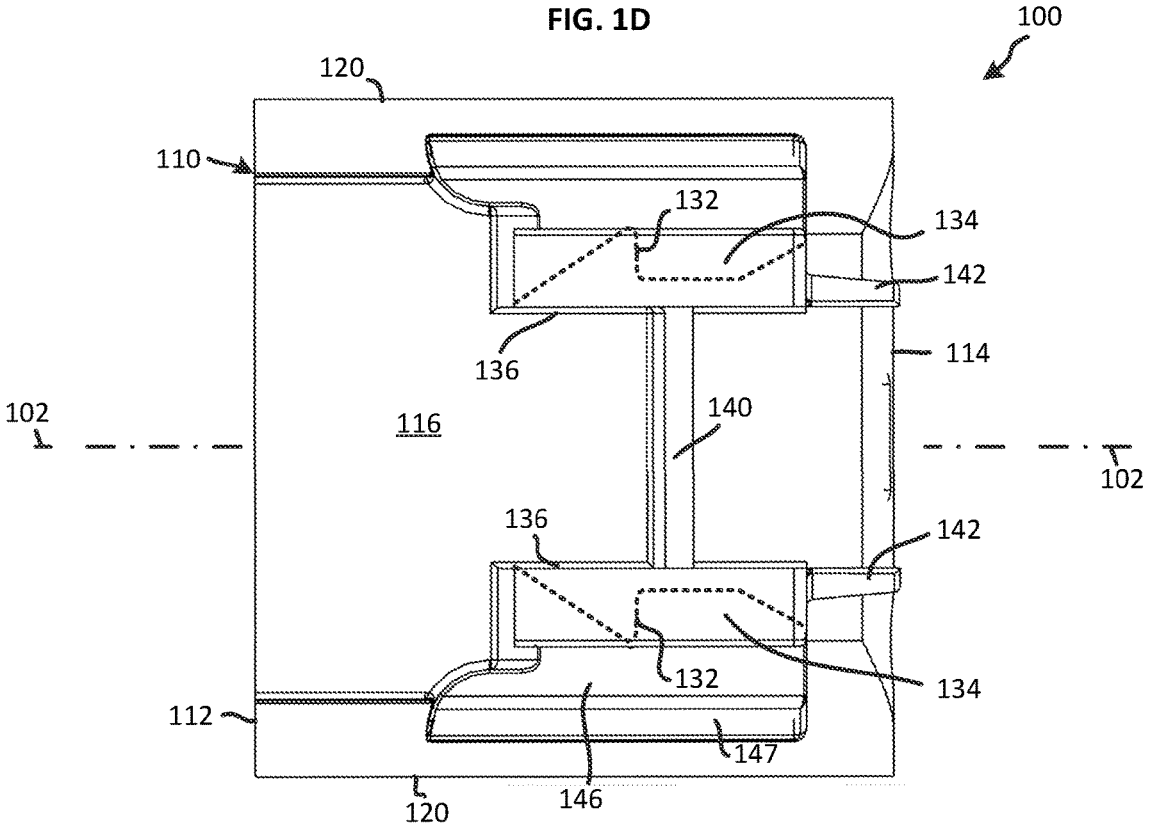
FIG. 1D is a top view of the baseplate of FIG. 1A, in accordance with an embodiment of the present disclosure.

FIGS. 1A-1D illustrate views of a baseplate 100, in accordance with an embodiment of the present disclosure. FIG. 1A is a top and rear perspective view, and FIG. 1B is a front perspective view, FIG. 1C is a side view, and FIG. 1D is a top view.

In accordance with some embodiments, the baseplate 100 includes a body 110 that extends along a central axis 102 from a proximal end 112 to a distal end 114. The body 110 generally has a cuboid geometry with a top 116, a bottom 118, and sides 120. The body 110 is oriented so that the central axis 102 is substantially parallel to, an may be vertically over, the firearms bore axis. In this example embodiment, the top 116 has generally planar geometry of rectangular or square shape oriented normal to the central axis 102. Each side 120 extends down from the top 116. The sides 120 are shown as having a rounded upper portion, although this is not required. In some such embodiments, the top 116 of the baseplate 100 simulates being an extension of the lower receiver such that, in use, the top 116 is substantially flush with the top surface of the lower receiver (e.g., ±1 mm).

Figure 5:
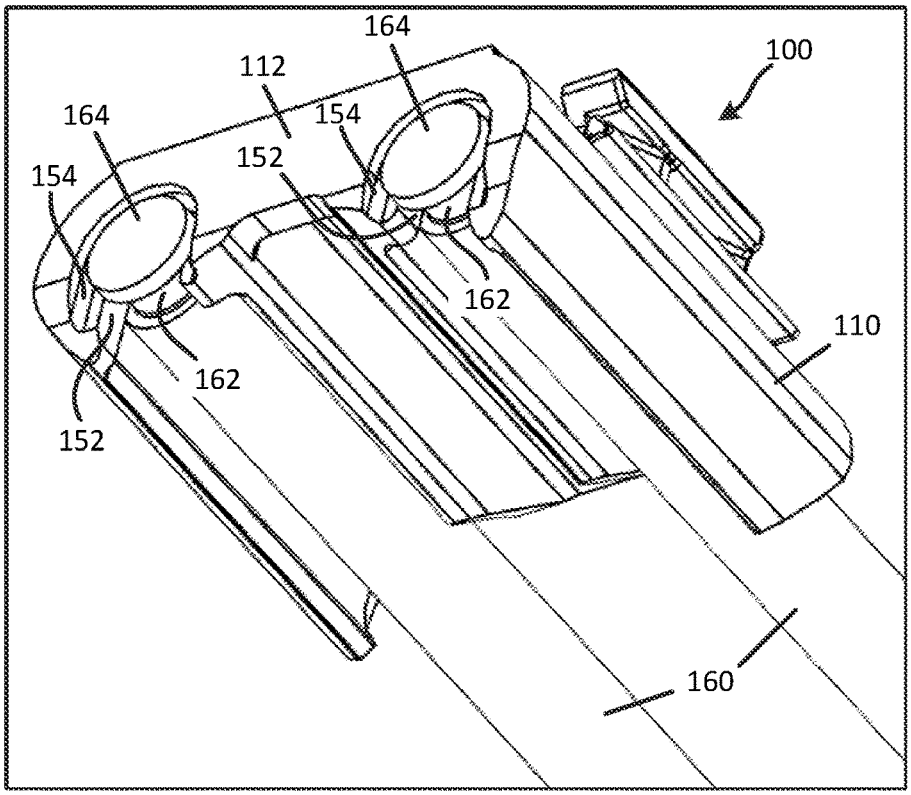
FIG. 5 is a bottom and rear perspective view showing the guide rods installed in the baseplate, in accordance with an embodiment of the present disclosure.
Figure 6:
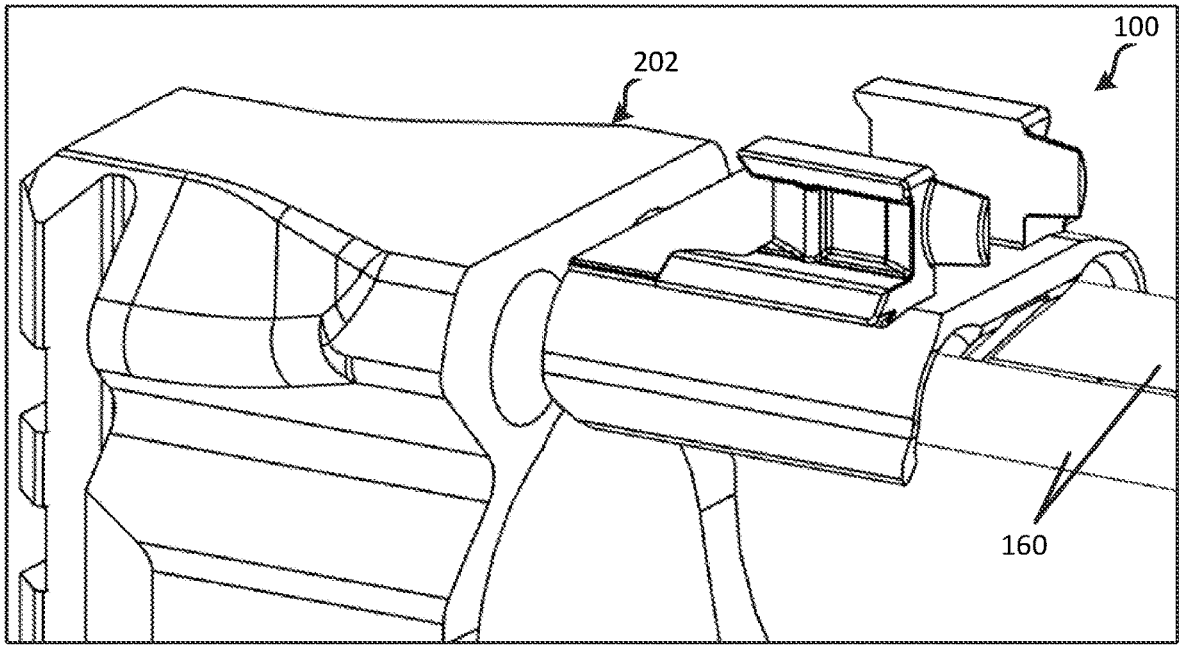
FIG. 6 is a side view showing a baseplate positioned adjacent the upper, rear portion of a lower receiver, in accordance with an embodiment of the present disclosure.

A latch plate 130 extends up from the top 116 and defines at least one catch surface 132 configured to engage the hook-like latch of a charging handle (e.g., shown in FIGS. 5-6). For example, the catch surface 132 can be defined by a lateral recess 134 into the latch plate 130 or equivalent structure. In one embodiment, the latch plate 130 includes a pair of walls 136, each of which extends up from the top 116 and is oriented along the central axis 102 in a spaced-apart parallel orientation. One or both walls defines a lateral recess 134 and catch surface 132 in the outside lateral face. In the top view of FIG. 1D the lateral recesses 134 and catch surfaces 132 are illustrated in broken lines.

In some embodiments, a brace 140 extends between and connects walls 136. In one such embodiment, the brace 140 and walls 136 are arranged to generally define an H shape as viewed from above. The brace 140 can have a vertical height that is less than that of the walls 136, such as being equal to or less than half of a vertical height of the walls 136. The latch plate 130 defines a channel 144 between the walls 136, the channel 144 sized to receive the elongated body of a charging handle. For example, the channel 144 has a lateral width of about 0.4 inch and a vertical height of about 0.2 inch. In embodiments that include the brace 140, the bottom of the channel 144 can be defined by the brace 140. In some embodiments, the channel 144 is sized and arranged so that the top of the charging handle body is slightly below (e.g., —1 mm) the top surface 136*a* of each wall 136. For example, the charging handle body can reciprocate axially through the channel 144 defined on its sides by walls 136, below by brace 140, and above by part of the upper receiver that abuts the top surfaces 136*a* of the walls 136.

In some embodiments, the latch plate 130 includes shelves 146 that extend laterally outward from each wall 136 along the top 116 of the body 110. For example, each shelf 146 extends laterally over or beyond a side 120 of the body 110 so as to define a tongue 148 that overhangs the body 110. When the baseplate 100 is installed in the upper receiver 300 (shown, e.g., in FIG. 16), the tongue 148 can stabilize the baseplate 100 during use by being received in a corresponding groove, recess, or slot, or by engaging a surface of the upper receiver 300, for example. As shown in the example of FIGS. 1A-1D, the shelf 146 can function as a support and/or guide for the latch 256 of the charging handle 250. Accordingly, the shelf 146 can define a chamfer 147 to guide the latch 256 into the lateral recess 134. In other embodiments, the shelf 146 extends laterally from another portion of the wall 136, such from the top 136*a* of the wall 136.

The latch plate 103 can further define one or more protrusions 142 extending forward from each wall 136. As shown in the example of FIGS. 1A-1D, protrusions 142 have an arcuate outside face and a planar inside face that is continuous with an inside face of the corresponding wall 136. In such embodiments, the inner face of the protrusions 142 define part of the channel 144. The protrusions 142 can be received in a corresponding recess defined in the upper receiver 300. In other embodiments, each protrusion 142 can be of other suitable geometries.

Figure 3:
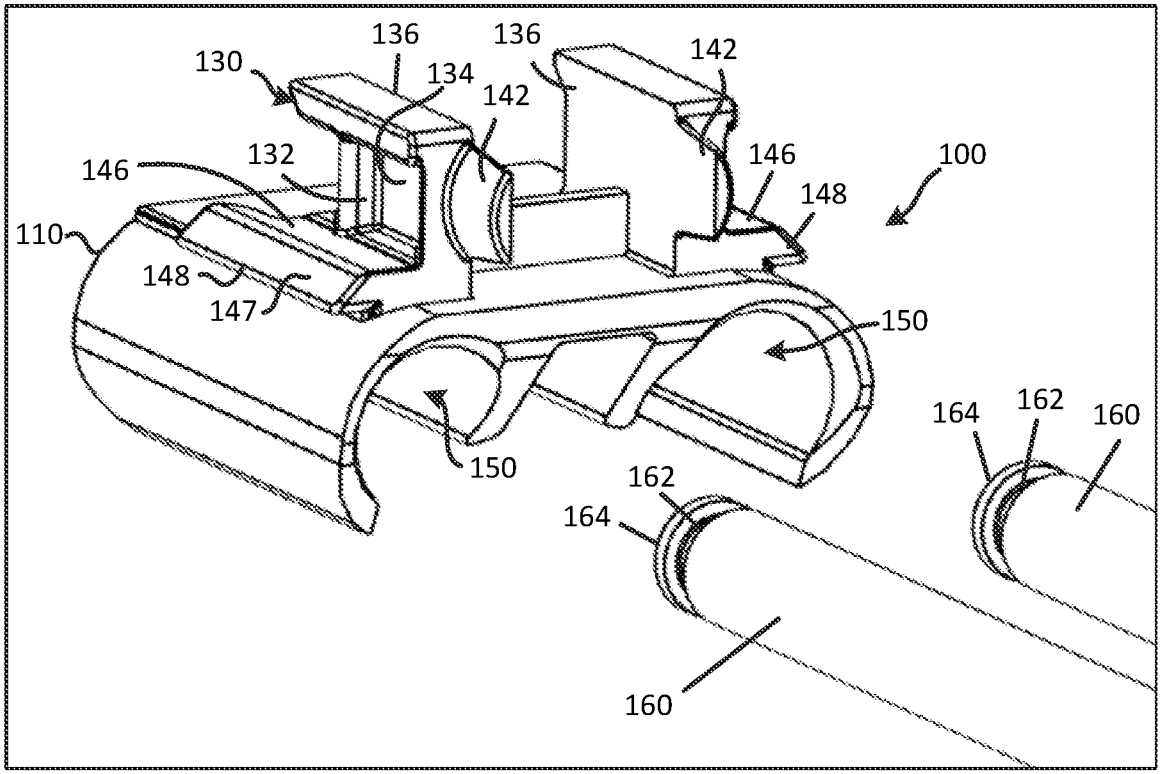
FIG. 3 is a front perspective view of a baseplate and end portions of recoil spring guide rods, in accordance with an embodiment of the present disclosure.

The body 110 defines a guide rod recess 150 for receiving an end of each spring guide rod 160 (shown, e.g., in FIG. 3). In the example shown, the body 110 defines two guide rod recesses 150, one for each spring guide rod on opposite sides of the central axis 102. In this example, the body 110 defines a central aperture 151 positioned between the guide rod recesses 150. The central aperture 151 can be sized to receive part of the recoil connector 170 when the bolt is drawn rearward, for example. In other embodiments, a single guide rod or more than two guide rods can be used, as deemed appropriate for a particular application. Each guide rod recess 150 can be generally cylindrical or can have some other suitable geometry for receiving an end of the spring guide rod 160.

In some embodiments, each spring guide rod 160 can be retained in the guide rod recess 150 using a pin, fastener, catch, or other suitable mechanism. In other embodiments, such as shown in FIG. 1A, each guide rod recess 150 has a region of reduced size 152, such as a slot defined in the proximal end 112 of the baseplate 100, such that a neck 162 on the end of the spring guide rod is received in the region of reduced size 152 to retain the spring guide rod. As also shown in FIG. 1A, each opening can include a counterbore 154 to receive a relatively larger end 164 of the spring guide rod 160. In some such embodiments, the end 164 of the spring guide rod 160 is generally flush with the proximal end 112 of the baseplate 100 when the neck 162 is positioned in the region of reduced size 152 (e.g., slot).

Note in the side view of FIG. 1C that the proximal end 112 of the body 110 includes a vertical face 112*a* configured to engage a corresponding vertical face of the lower receiver. Other geometries are acceptable.

Figure 2:
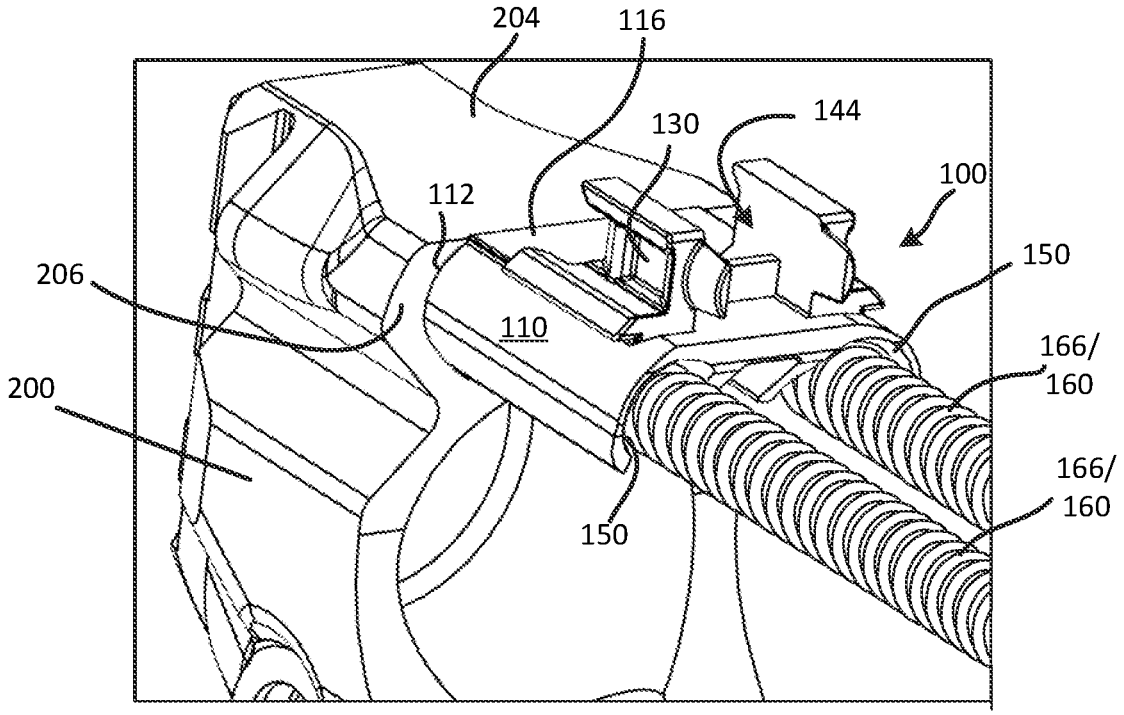
FIG. 2 is a front perspective view showing portions of a recoil assembly and a lower receiver, in accordance with an embodiment of the present disclosure.

Referring now to FIG. 2, a perspective view illustrates top, front, and sides of baseplate 100, recoil springs on spring guide rods 169, and a portion of the lower receiver 200, in accordance with an embodiment of the present disclosure. In this example, a portion of the recoil springs 166 and spring guide rods 160 are received in the guide rod recesses 150 of the baseplate 100. The proximal end 112 of the body 110 abuts the forward face 206 of the lower receiver 200 with the top 116 of the body 110 substantially flush with the top surface 204 of the lower receiver 200. As discussed above, the latch plate 130 defines channel 144 for reciprocating movement of the charging handle.

FIG. 3 illustrates a front perspective view of a baseplate 100, in accordance with an embodiment of the present disclosure. As noted above, the latch plate 130 includes walls 136, each of which defines a lateral recess 134 and catch surface 132. Each wall 136 also includes a shelf 146 extending laterally from the base of the wall 136 along the top 116 of the body 110 to define a tongue 148. Protrusions 142 extend forward from each wall 136. FIG. 3 also shows end portions of spring guide rods 160 positioned for installation in guide rode recesses 150.

Figure 4:
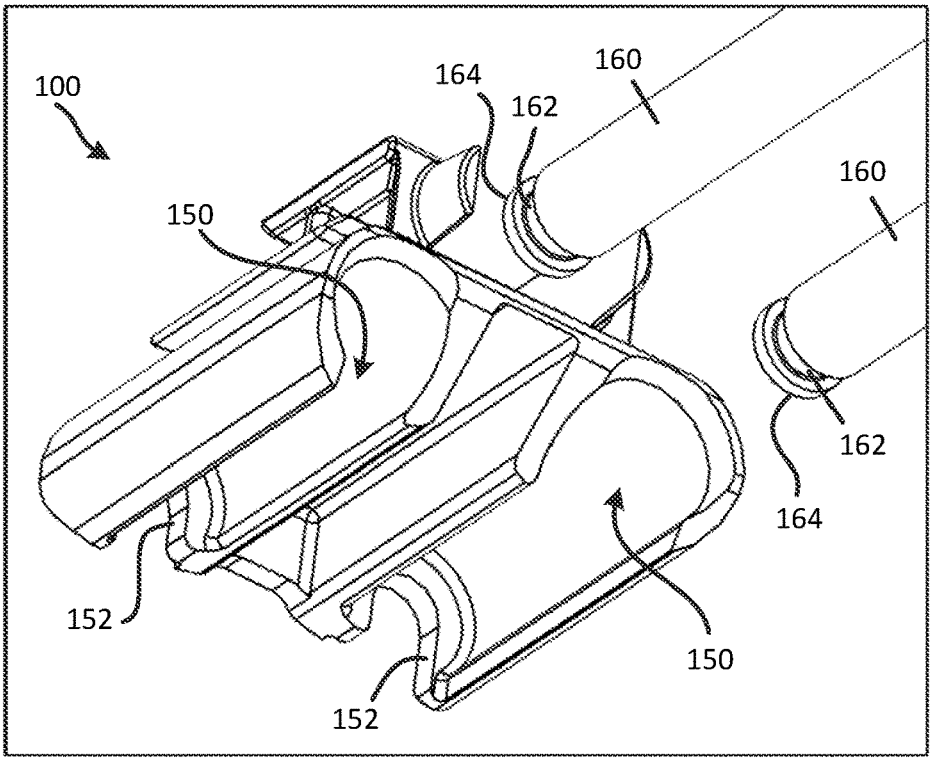
FIG. 4 is a bottom and front perspective view showing the baseplate and guide rods 160 of FIG. 3, in accordance with an embodiment of the present disclosure.

FIG. 4 illustrates a front and bottom perspective view of spring guide rods 160 and baseplate 100, in accordance with an embodiment of the present disclosure. Each spring guide rod 160 has a neck 162 of reduced diameter adjacent its end 164. FIG. 4 also shows the regions of reduced size 152 at the proximal end of each guide rod recess 150.

FIG. 5 illustrates a bottom and rear perspective view of the baseplate 100 and recoil spring guide rods 160 of FIG. 4 with the guide rods 160 received in the guide rod recesses 150 of the baseplate 100. The neck 162 of each spring guide rod 160 is received in the region of reduced size 152, which is configured as a slot in this example. The end 164 of each spring guide rod 160 is recessed into the corresponding counterbore 154 adjacent the region of reduced size 152, and each end 164 is substantially flush with the proximal end 112 of the body 110.

Figure 7:
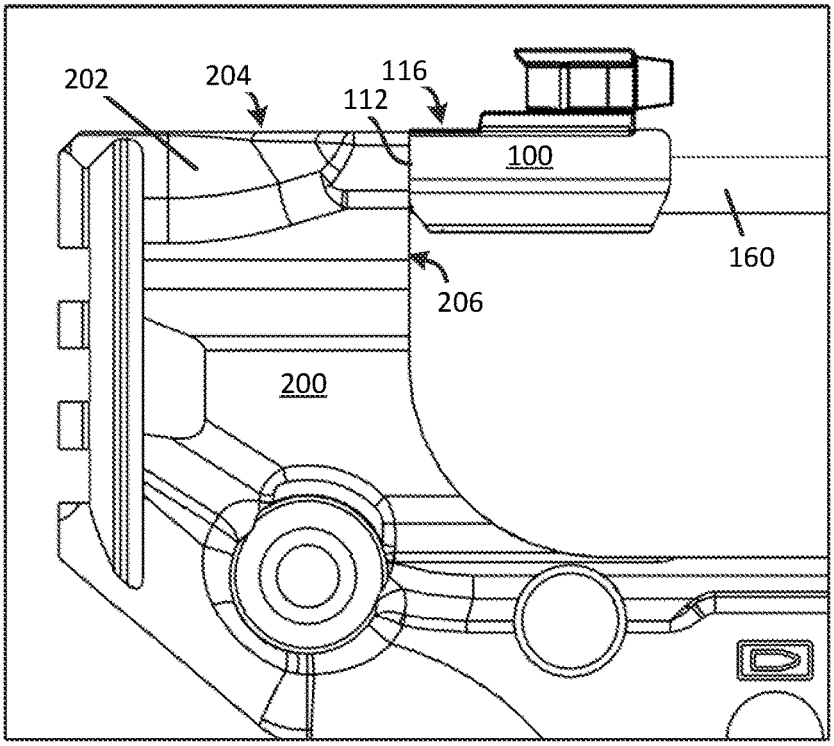
FIG. 7 is a side view showing the baseplate and upper, rear portion of a lower receiver with the baseplate in an installed position, in accordance with an embodiment of the present disclosure.

FIG. 6 illustrates a side and front perspective view of a baseplate 100 with spring guide rods 160 and an upper, rear portion 202 of the lower receiver 200, in accordance with an embodiment of the present disclosure. For clarity of illustration, the recoil springs 166 are not shown. The recoil assembly is positioned for installation. Note that the baseplate 100 is spaced forward of the upper, rear portion 202 of the lower receiver 200. FIG. 7 shows the recoil assembly in an installed position with the lower receiver 200. Note that the proximal end 112 of the baseplate abuts the forward face 206 of the upper, rear portion 202 of the lower receiver and the top 116 of the baseplate 100 is substantially flush with the top surface 204 of the lower receiver 200.

Figure 8:
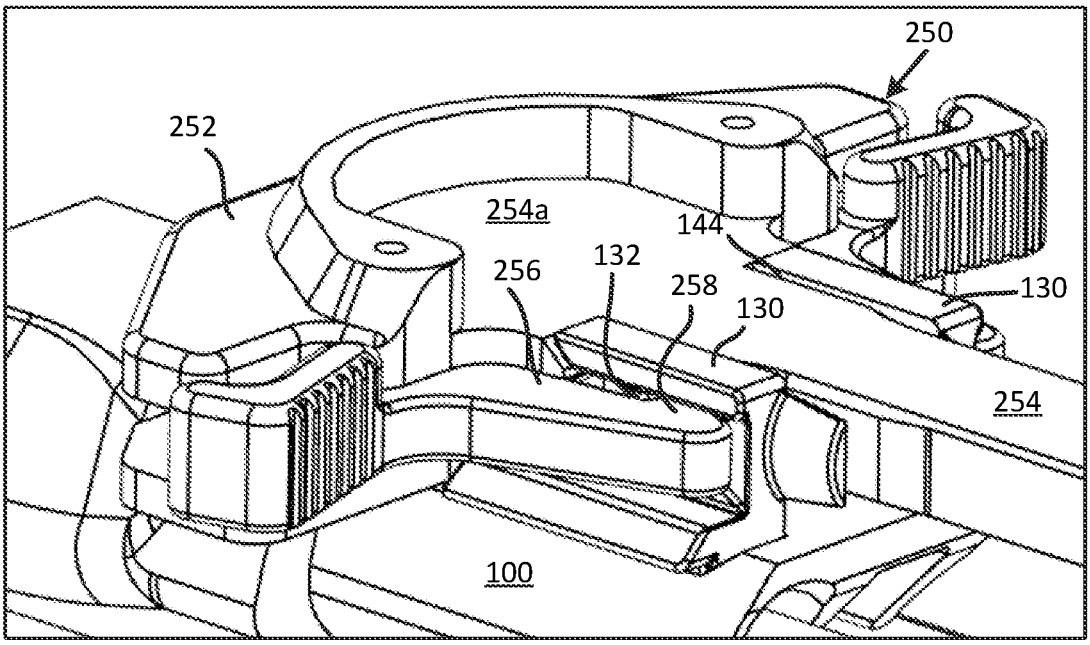
FIG. 8 is a front perspective view showing a charging handle in a latched condition with a baseplate, in accordance with an embodiment of the present disclosure.
Figure 9:
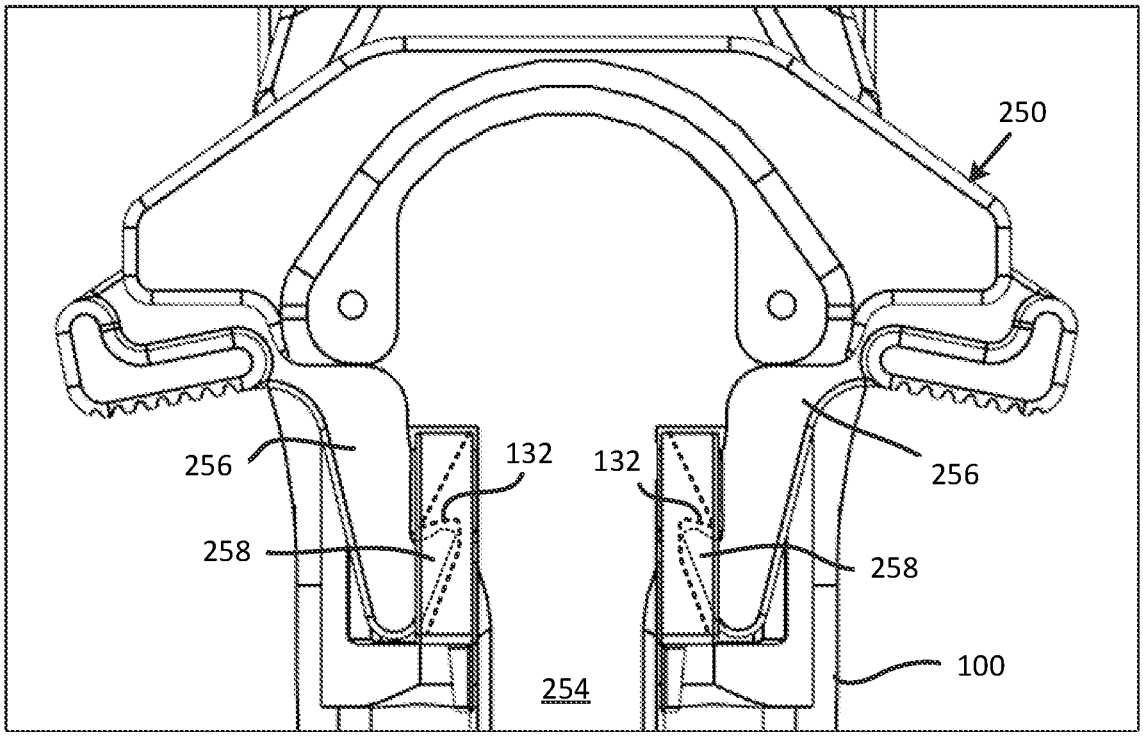
FIG. 9 is a top view of the charging handle and baseplate of FIG. 8, in accordance with an embodiment of the present disclosure.

FIG. 8 illustrates a top and front perspective view showing a charging handle 250 in a latched position with the baseplate 100, in accordance with an embodiment of the present disclosure. The charging handle 250 includes a longitudinal body 254 with a handle 252 on its proximal end 254*a*. Latches 256 on opposite lateral sides of the handle 252 extend forward and have a hook-like catch 258 that engages the catch surface 132 of each wall 136 of the latch plate 130. Note that the body 254 of the charging handle 250 is received in the channel 144 defined between the walls 136 of the latch plate 130. FIG. 9 illustrates a top view of the charging handle 250 in a latched position with the baseplate 100, in accordance with an embodiment. The catch surfaces 132 are illustrated in broken lines in this example.

Figure 10:
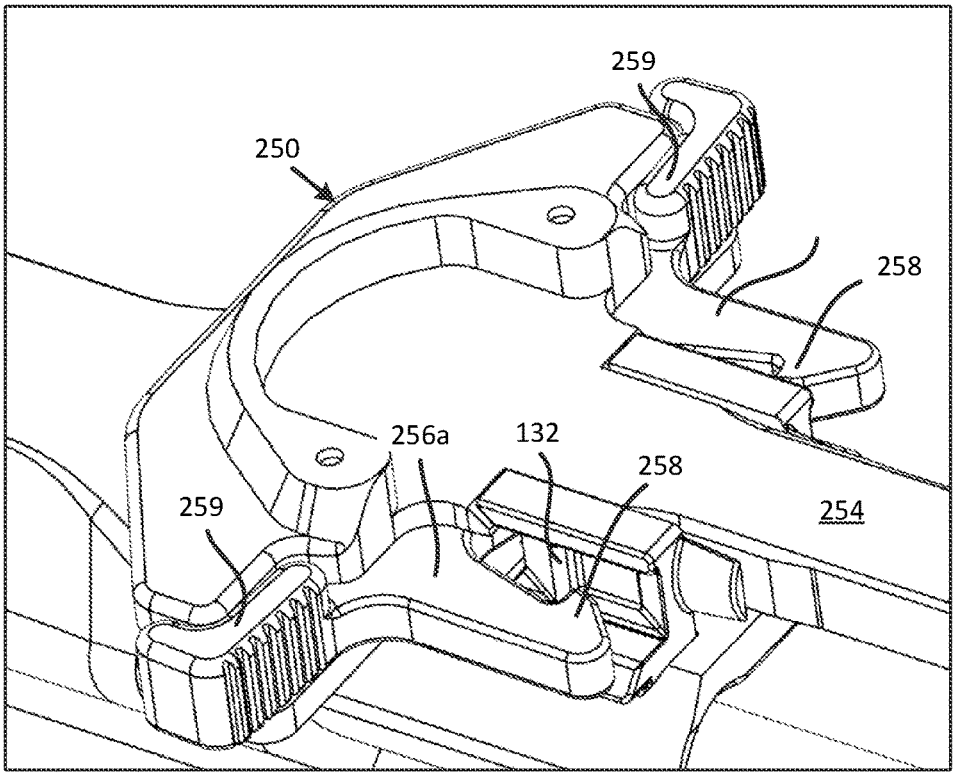
FIGS. 10-11 are top and front perspective views showing a charging handle in an unlatched condition with latches disengaged from the baseplate, in accordance with an embodiment of the present disclosure.
Figure 11:
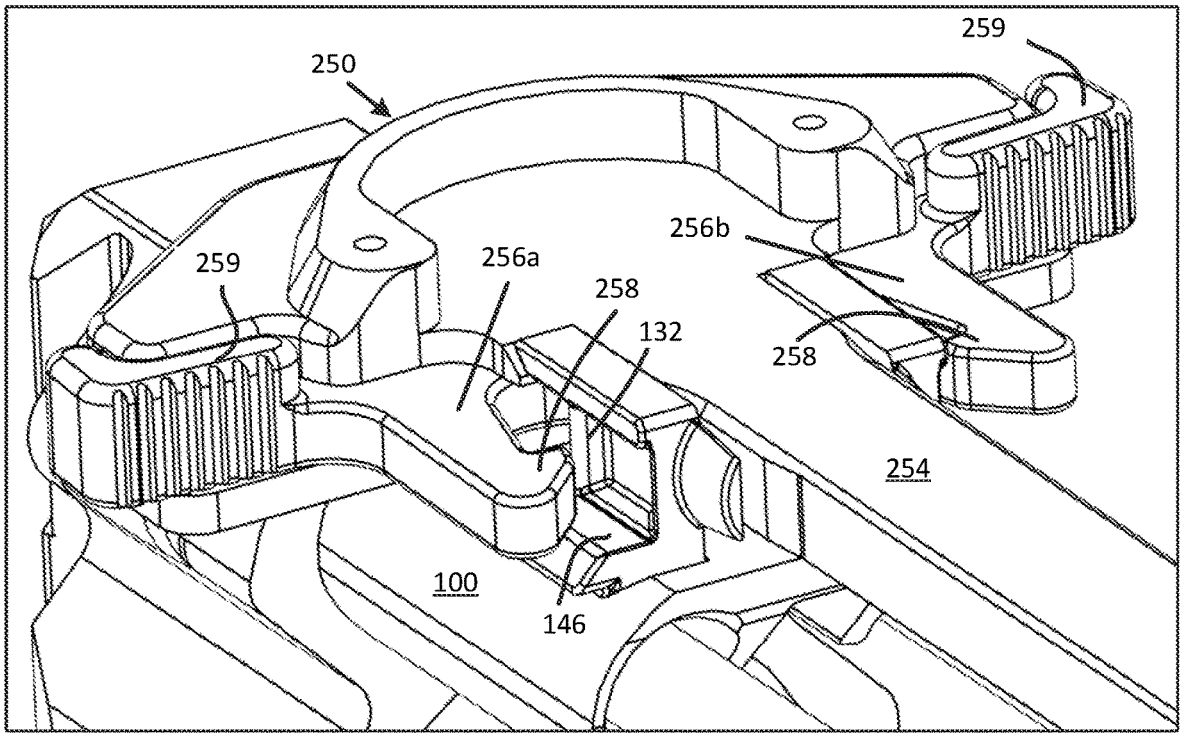

FIGS. 10 and 11 illustrate a top and front perspective view showing a charging handle 250 with one of the latches 256 in an unlatched position, in accordance with an embodiment of the present disclosure. Levers 259 of the right-side latch 256*a* and left-side latch 256*b* are in a rearward position with the respective catches 258 disengaged from the catch surfaces 132 on the latch plate 130. Note that when charging handle 250 is configured for ambidextrous operation, levers 259 may be operatively coupled so that only one of levers 259 need be pulled to cause both levers to move rearward and disengage both catches 258. In other embodiments, levers 259 (and respective catches 258) operate independently of one another. Note that levers 259 are guided towards lateral recess 134 and catch surface 132 by shelf 146, a top surface of which can also provide support to the latch 256.

Figure 12:
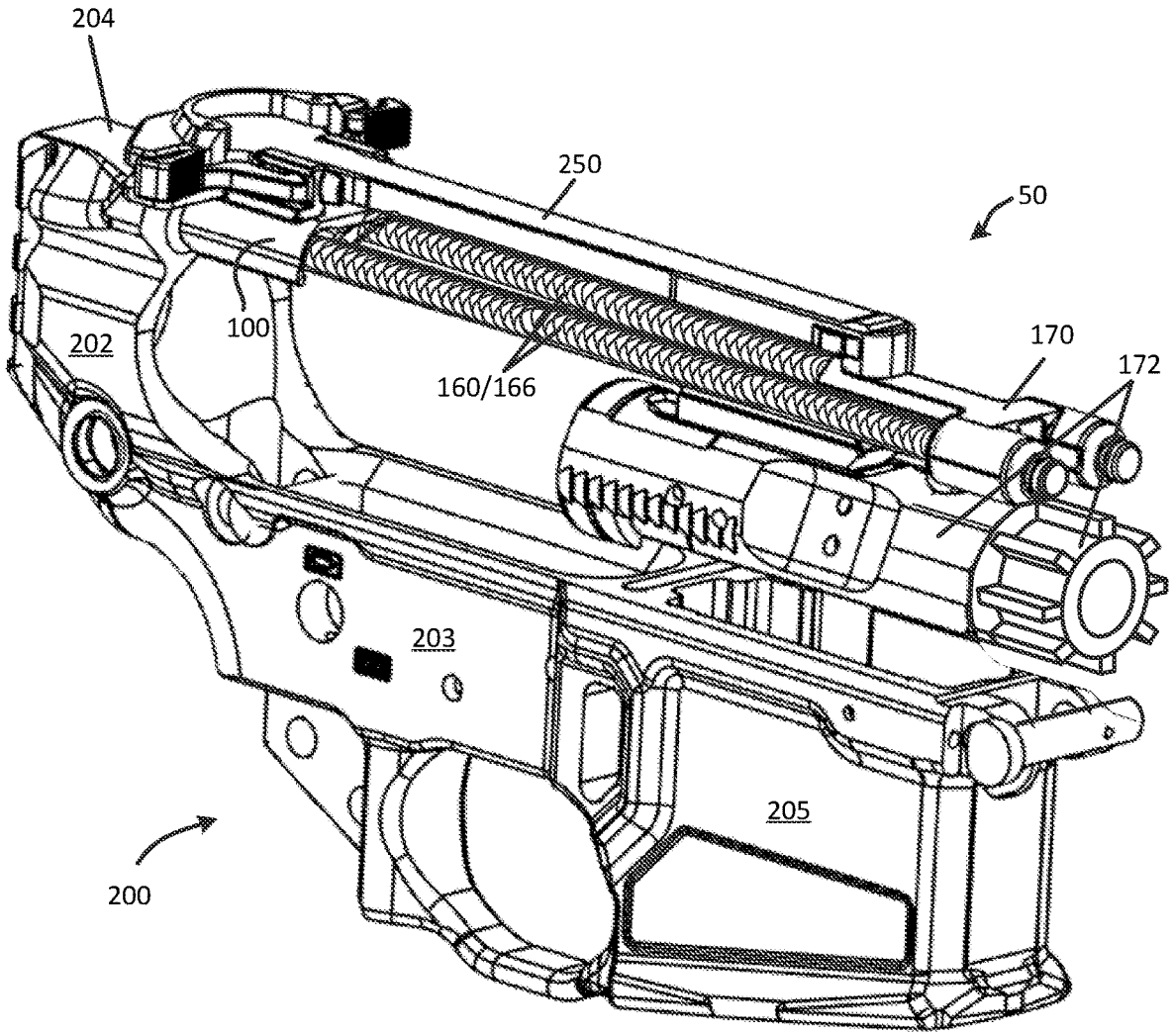
FIG. 12 illustrates a front and side perspective view showing components of a recoil assembly and lower receiver, where the charging handle is in a latched condition, in accordance with an embodiment of the present disclosure.

FIG. 12 illustrates a front and side perspective view of a lower receiver 200 together with components of a recoil assembly 50, in accordance with an embodiment of the present disclosure. In this example, the lower receiver 200 includes a body 201 that defines the trigger well 203 and magazine well 205. The upper, rear portion 202 extends up from a rear portion of the body 201 and includes a top surface 204. The recoil assembly 50 includes a baseplate 100, charging handle 250, recoil spring guide rods 160 with recoil springs 166, a recoil connector 170, and bolt/carrier group 172. In this example, the recoil connector 170 couples the bolt/carrier group 172 to the recoil spring guide rods 160 and recoil springs 166. The charging handle 250 engages the recoil connector 170 to enable the user to use the charging handle 250 to draw the bolt/carrier group 172 rearwardly, such as when charging the action. As shown, the spring guide rods 160 are vertically above the path of the bolt/carrier group 172 and the charging handle 250 is above the spring guide rods 160. Numerous variations on the components of the recoil assembly 50 are contemplated. In FIG. 12, the charging handle 250 is in a latched position with respect to the baseplate 100.

Figure 13:
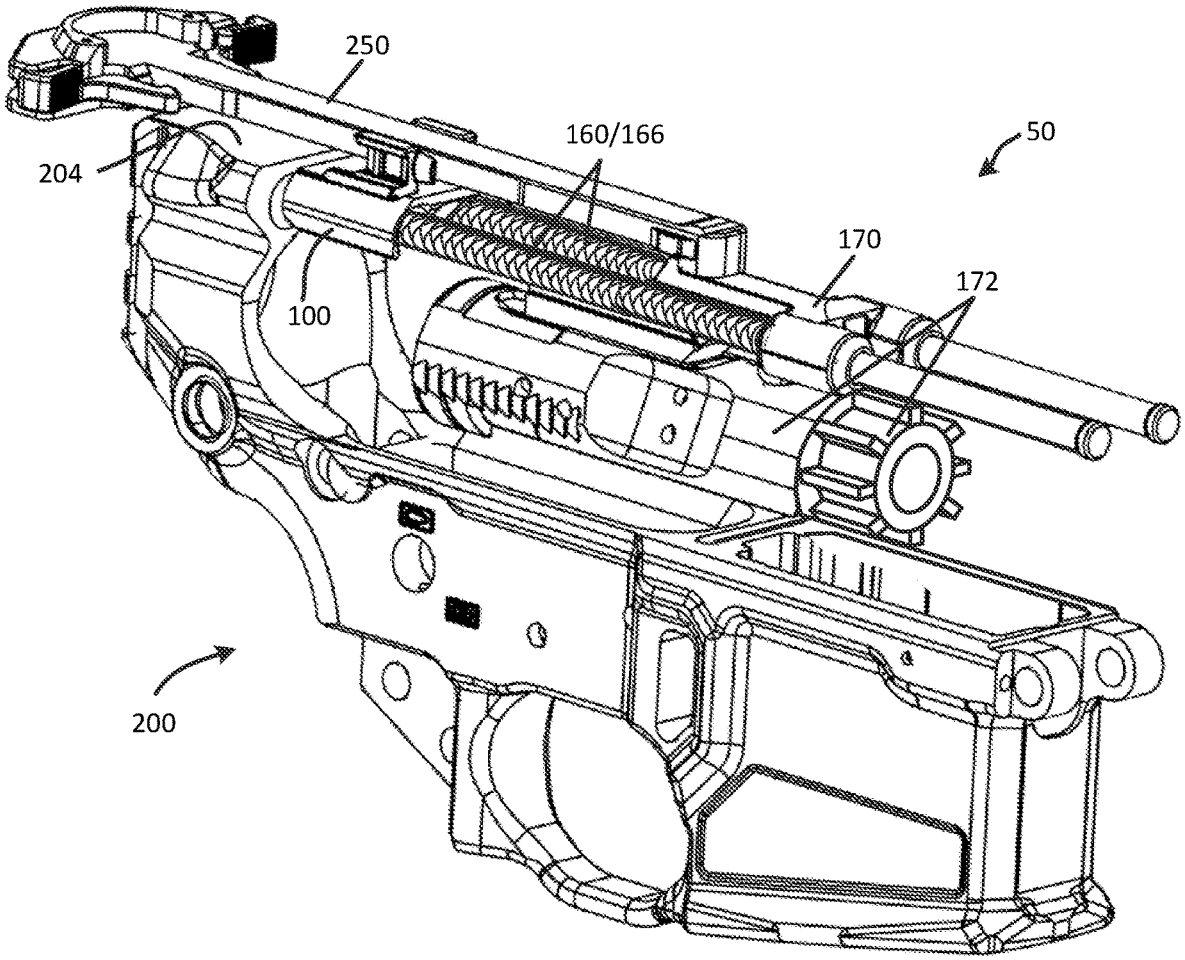
FIG. 13 illustrates a front and side perspective view of the recoil assembly and lower receiver of FIG. 12 unlatched from the baseplate and with the charging handle and portions of the recoil assembly drawn rearwardly, in accordance with an embodiment of the present disclosure.

FIG. 13 shows the lower receiver 200 and recoil assembly 50 of FIG. 12 in a partially retracted position, in accordance with an embodiment of the present disclosure. In this example, the charging handle 250 has been unlatched from the latch plate 130 of the baseplate 100 and drawn rearwardly over the top surface 204 of the lower receiver 200. In doing so, the bolt/carrier group 172 is also drawn rearwardly against spring force of recoil springs 166 due to engagement between the charging handle 250 and the recoil connector 170.

Figure 14:
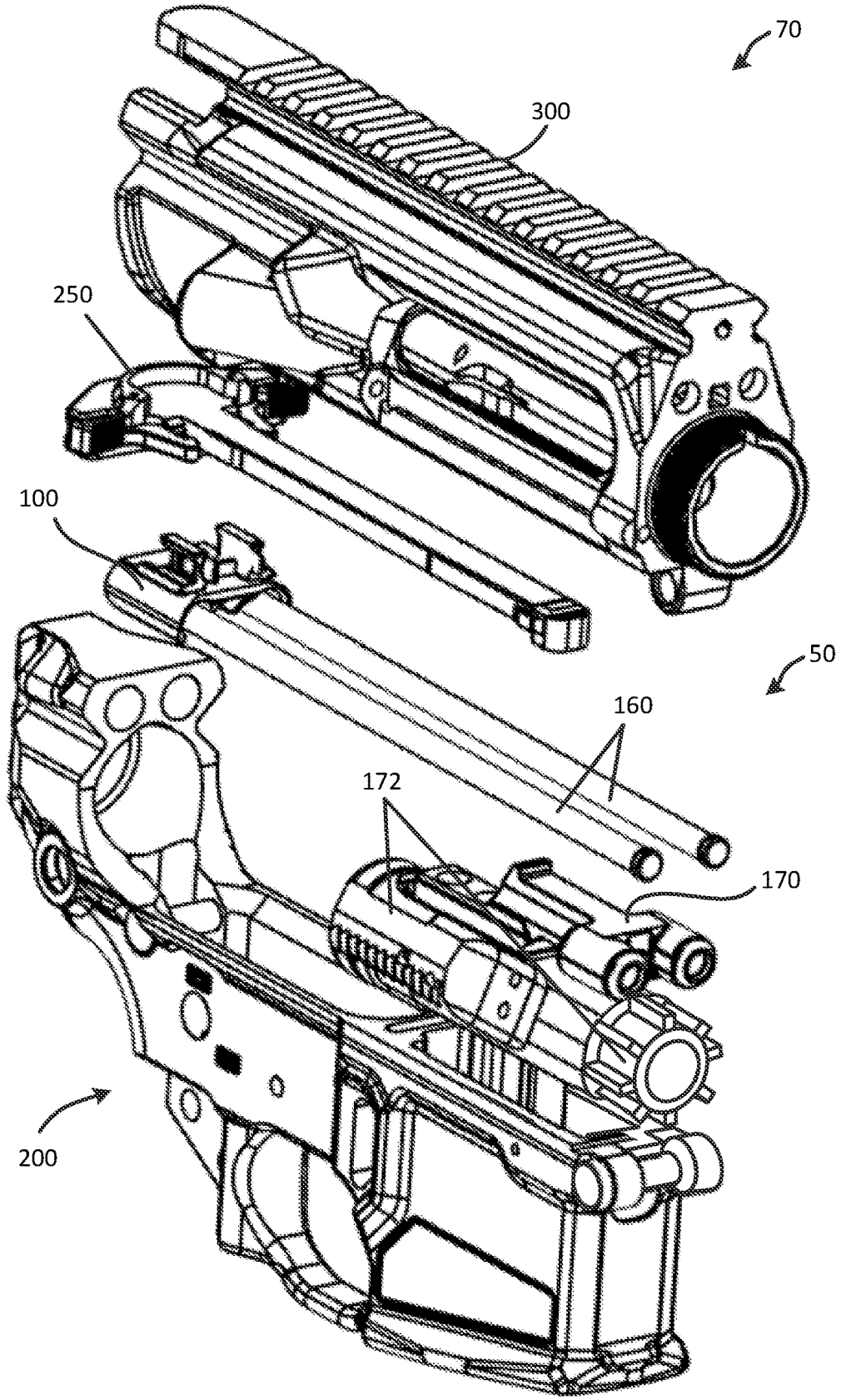
FIG. 14 illustrates a partially exploded, front perspective view showing components of a rifle assembly, in accordance with an embodiment of the present disclosure.

FIG. 14 illustrates a front perspective view showing components of a rifle assembly 70 that includes a lower receiver 200, recoil assembly 50, and upper receiver 300. For clarity of illustration, not all components of the rifle assembly are shown, such as components of the fire control assembly, barrel, stock, grip, and handguard. The recoil assembly 50 includes the baseplate 100, recoil spring guide rods 160 with recoil springs 166 (not shown), bolt/carrier group 172, recoil connector 170, and charging handle 250.

Figure 15:
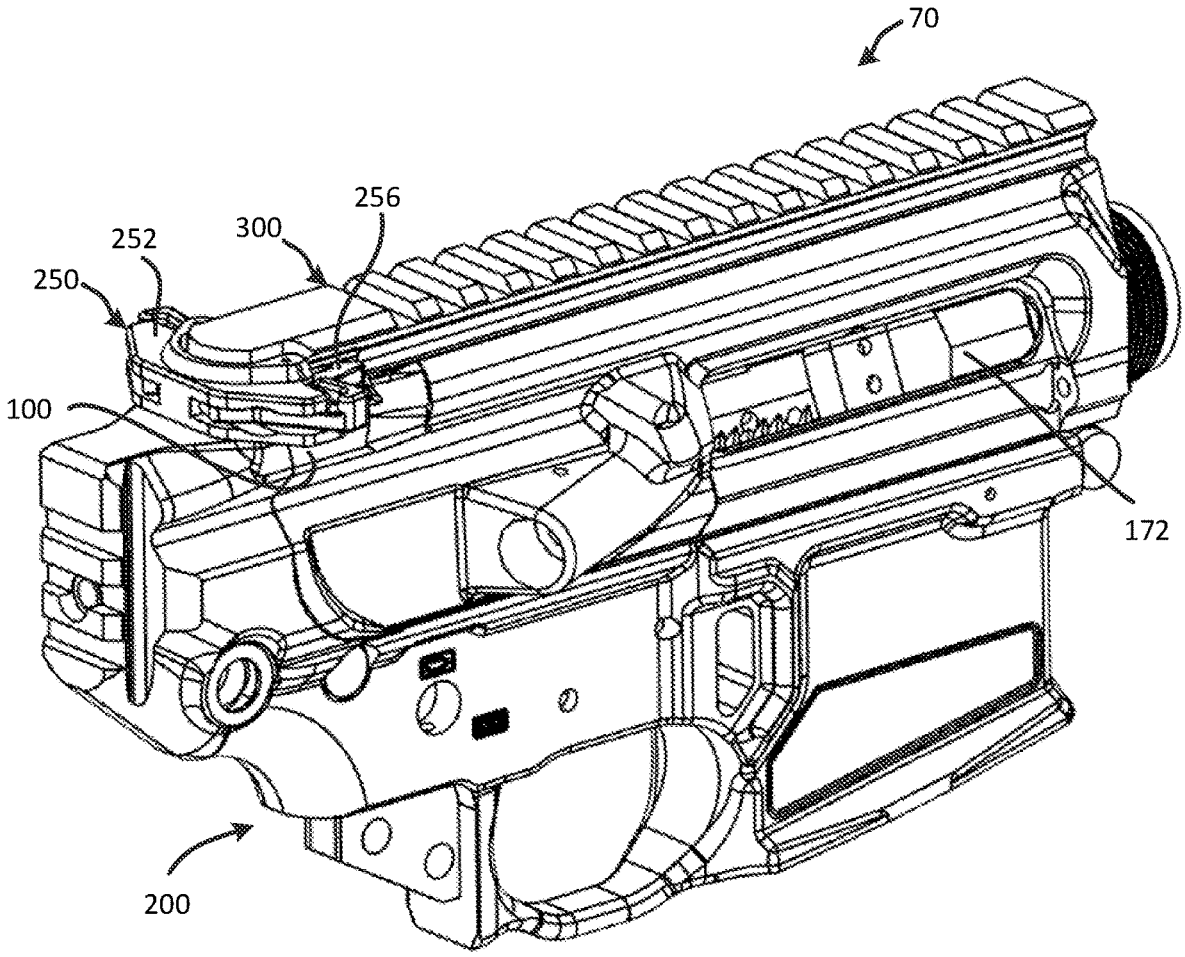
FIG. 15 illustrates a rear perspective view of the rifle assembly of FIG. 14 in an assembled condition.

FIG. 15 illustrates a rear perspective view of the rifle assembly of FIG. 14 in an assembled state, in accordance with an embodiment. In this example, the charging handle 250 is in a latched position with part of the handle 252 received in the upper receiver 300 and the latches 256 engaging the latch plate 130 of the baseplate 100.

Figure 16:
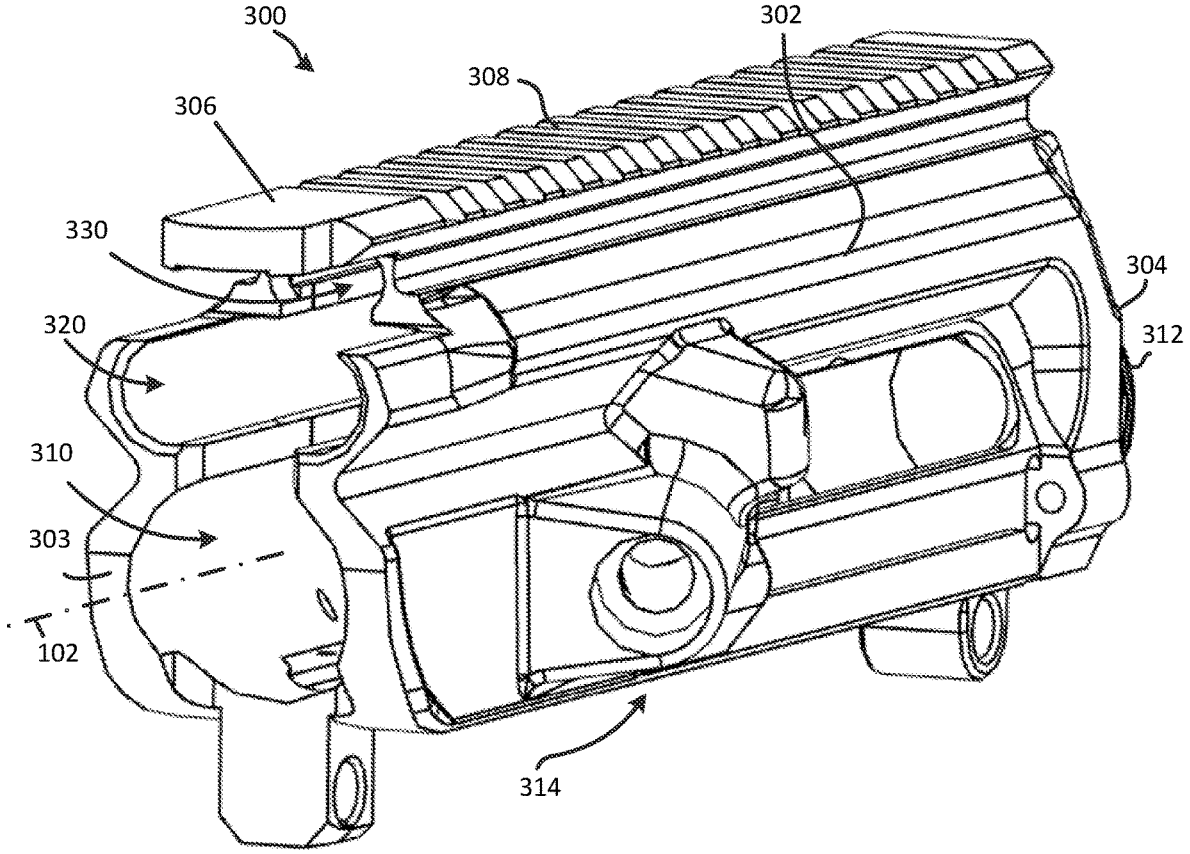
FIG. 16 illustrates a rear perspective view of an upper receiver that defines an aperture for a recoil baseplate, in accordance with an embodiment of the present disclosure.

FIG. 16 illustrates a rear perspective view of an upper receiver 300, in accordance with an embodiment of the present disclosure. The upper receiver includes an upper receiver body 302 that defines a bolt aperture 310 therethrough along the central axis 102 (e.g., bore axis) from the proximal end 303 to its exit at the distal end 304 via a barrel extension 312. The bolt aperture 310 generally has a circular cross-sectional shape. The bolt aperture 310 communicates with the lower receiver 200 below it (shown in FIG. 15) through an open bottom 314 and communicates with a recoil aperture 320 above it. The recoil aperture 320 generally has an oval cross-sectional shape of greater width than height, and is positioned above the bolt aperture 310. Above the recoil aperture 320 is a charging handle aperture 330 of generally rectangular cross-sectional shape. The bolt aperture 310, recoil aperture 320, and charging handle aperture 330 are regions of an open interior of the upper receiver 300. The top 306 of the upper receiver 300 is closed and may define a mounting rail 308. Adjacent the proximal end 303 of the charging handle aperture 330, the upper receiver 300 is recessed axially to define space to receive the handle 252 of the changing handle 250 between the top 306 and the recoil baseplate 100 (shown in FIG. 17).

Figure 17:
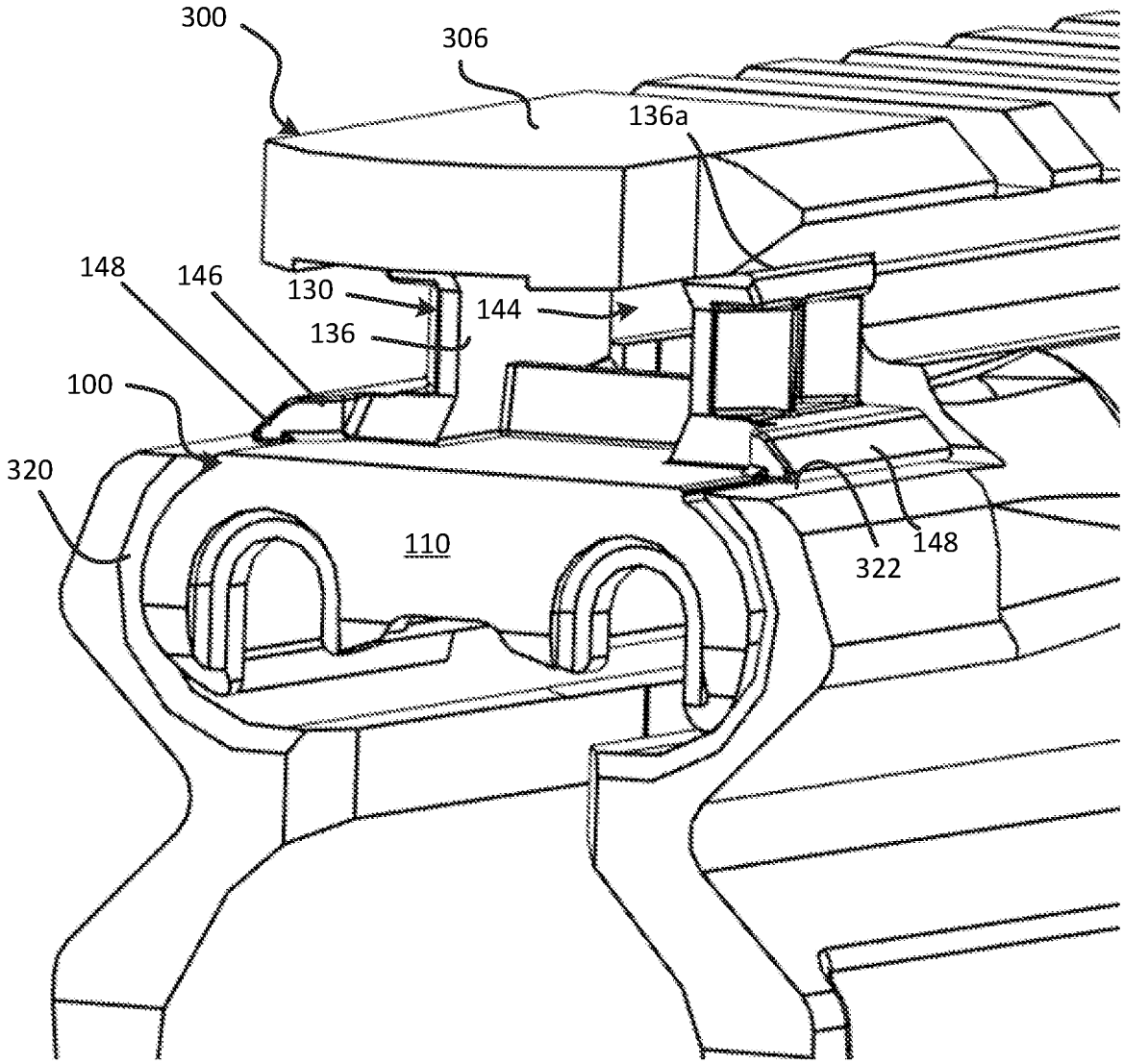
FIG. 17 illustrates a close-up view of the upper receiver of FIG. 16 with a recoil baseplate installed in the aperture, in accordance with an embodiment of the present disclosure.

FIG. 17 illustrates a rear perspective view of a recoil baseplate 100 installed in the upper receiver 300, in accordance with an embodiment of the present disclosure. The body 110 of the baseplate 100 is received in the recoil aperture 320 and the latch plate 130 is between the recoil aperture 320 and the top 306 of the upper receiver 300. As shown in this example, the top surfaces 136*a* of the walls 136 of the latch plate 130 abut the underside of the top 306 of the upper receiver 300. The channel 144 between walls 136 of the latch plate 130 is aligned axially with the charging handle aperture 330 (visible in FIG. 16). The tongue 148 on each shelf 146 of the latch plate 130 engages an upward-facing surface 322 of the upper receiver at the top of the recoil aperture 320. The top surface 136*a* of the wall 136 of the latch plate 130 abuts or is closely adjacent the underside of the top 306 of the upper receiver 300.

Figure 18:
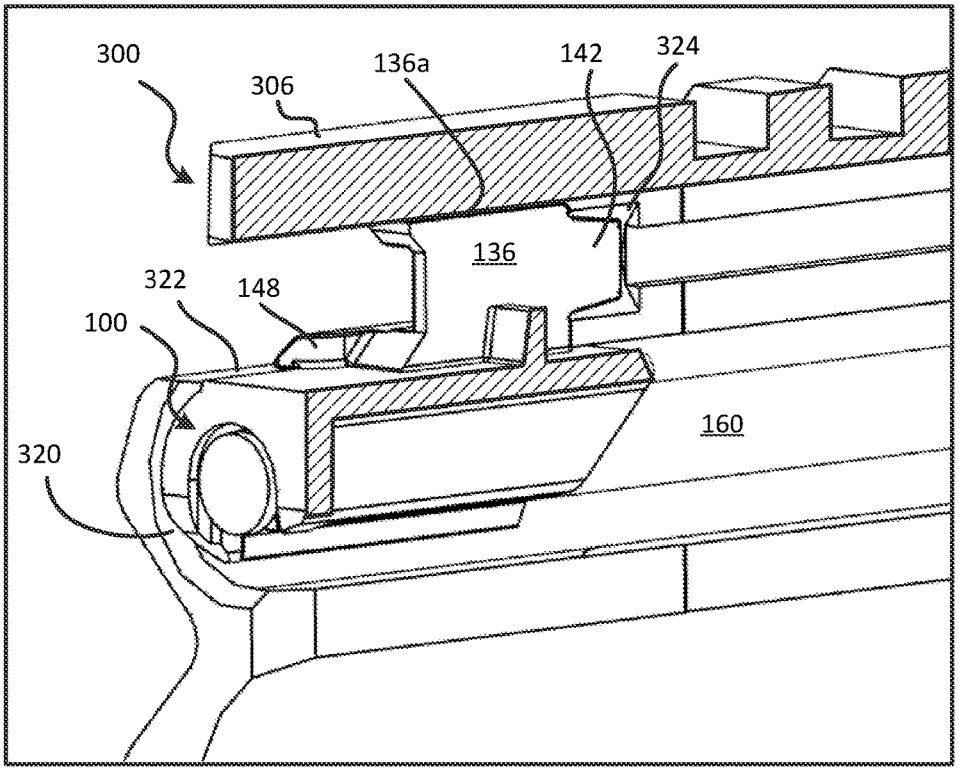
FIG. 18 illustrates a rear perspective view showing a longitudinal section taken through an upper receiver assembly, where the section is taken along a central vertical plane, in accordance with an embodiment of the present disclosure.

FIG. 18 illustrates a rear perspective view of a longitudinal section taken along the central plane of the upper receiver 300 and recoil baseplate 100, in accordance with an embodiment of the present disclosure. As noted above with reference to FIG. 18, the baseplate 100 is received in the recoil aperture 320 with tongues 148 overlapping and/or engaging the upward-facing surfaces 322 of the upper receiver 300 at the top of the recoil aperture 320. A recoil spring guide rod 160 is received in the baseplate 100. The top surface 136*a* of the wall 136 is closely adjacent or in contact with the underside of the top 306 of the upper receiver 300. A protrusion 142 on the front of the latch plate is received in corresponding protrusion recess defined in the upper receiver 300.

Figure 19:
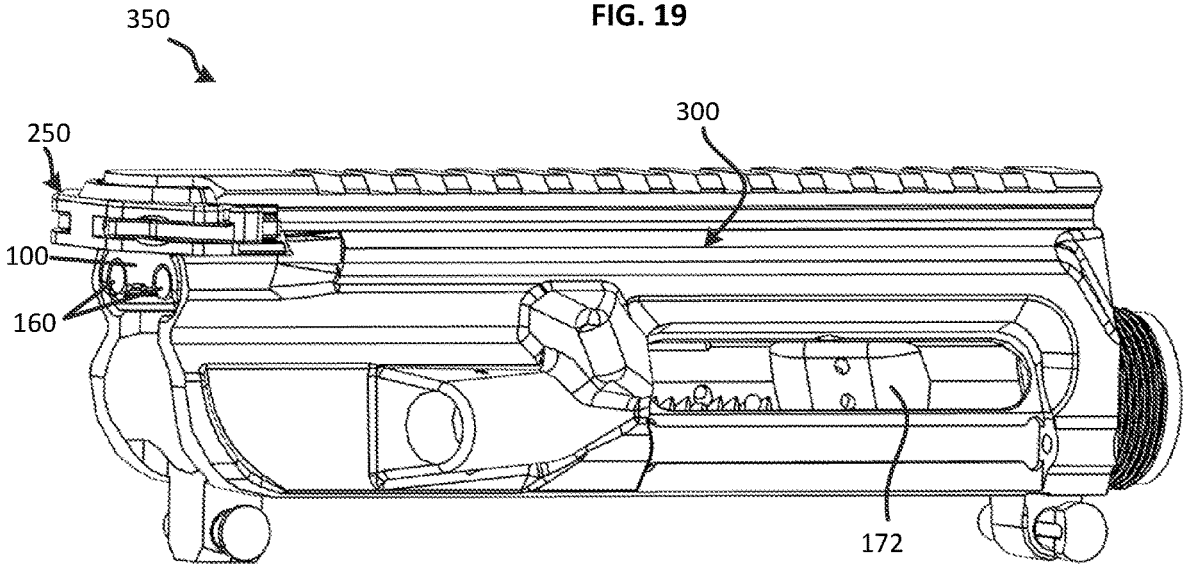
FIG. 19 is a side view of an upper receiver assembly that includes a baseplate received in an aperture defined in the upper receiver, a charging handle, and a bolt/carrier assembly, among other components, in accordance with an embodiment of the present disclosure.

FIG. 19 illustrates a side and rear perspective view of components of an upper receiver assembly 350, in accordance with an embodiment of the present disclosure. The upper receiver assembly 350 includes the upper receiver 300 and recoil assembly 50, which includes the baseplate 100, recoil spring guide rods 160 with recoil springs 166 (shown, e.g., in FIG. 2), bolt/carrier group 172, recoil connector 170 (shown, e.g., in FIG. 12), and charging handle 250. Although not shown, the upper receiver assembly 350 includes a barrel with gas system and a handguard, in some embodiments. Numerous variations and embodiments will be apparent in light of the present disclosure.

Figure 20:
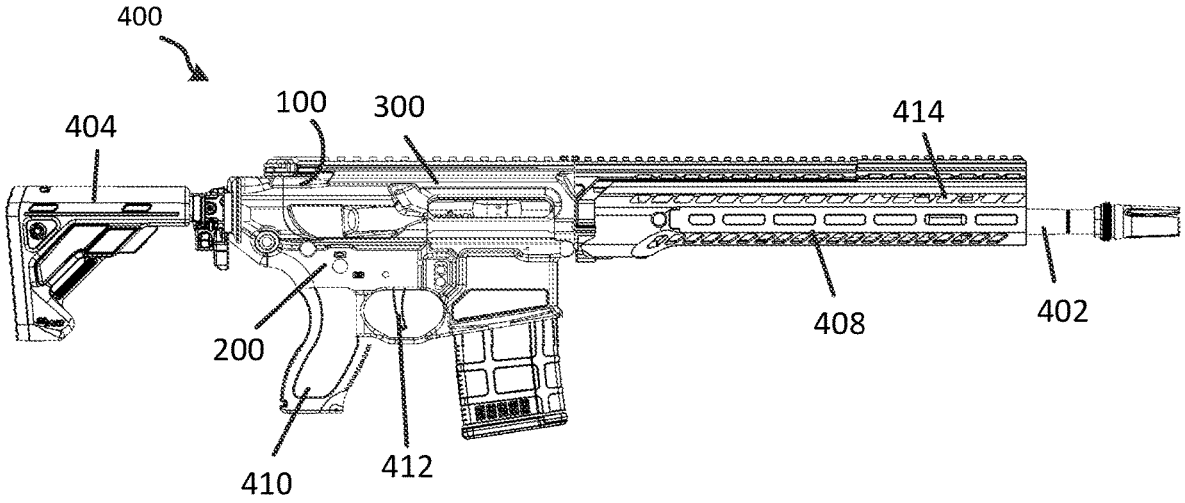
FIG. 20 illustrates a side view of a rifle incorporating a recoil assembly, in accordance with the present disclosure.

FIG. 20 illustrates a side view of a rifle 400 that includes the baseplate 100 and recoil assembly 250 as variously disclosed herein. The rifle 400 includes a barrel assembly 402 secured to the distal end of the upper receiver 300, the barrel assembly 402 including a barrel, gas block 414, and an operational rod (not visible) operatively connected between the gas block 414 and the recoil connector 170. The upper receiver 300 is removably attached to the lower receiver 200, which includes a grip 410, stock 404, and components of the fire control assembly, as will be appreciated.

Further Example Embodiments

The following examples pertain to further embodiments, from which numerous permutations and configurations will be apparent.

Example 1 is a recoil assembly for a rifle, the recoil assembly comprising a baseplate body extending longitudinally along a central axis from a proximal end to a distal end, the baseplate body defining an opening extending along the central axis and configured to receive an end portion of a recoil spring guide rod; and a latch plate extending up from a top of the baseplate body, the latch plate defining a charging handle opening and a catch surface.

Example 2 includes the subject matter of Example 1, wherein the latch plate comprises laterally spaced-apart walls aligned along the central axis, the charging handle opening between the walls and the catch surface defined in a lateral face of one or both walls.

Example 3 includes the subject matter of Example 2, wherein the laterally spaced-apart walls include a first wall on a first side of the central axis and a second wall on a second side of the central axis.

Example 4 includes the subject matter of Example 3, wherein the first wall is spaced from the second wall by a gap of 0.3 to 0.5 inch.

Example 5 includes the subject matter of any of Examples 3 or 4, comprising a lateral wall extending between and connecting lower portions of the first wall and the second wall, a vertical height of the lateral wall being less than a vertical height of the first wall and the second wall.

Example 6 includes the subject matter of any of Examples 3-5, wherein an outside face of the first wall defines a first catch surface and an outside face of the second wall defines a second catch surface.

Example 7 includes the subject matter of any of Examples 1-6, comprising a protrusion extending distally from the latch plate.

Example 8 includes the subject matter of any of Examples 1-7 and comprises at least one guide rod extending axially from a proximal end portion to a distal end portion, the proximal end portion received in the opening of the baseplate body; a recoil connector slidably mounted on the at least one guide rod; and a recoil spring on the at least one guide rod between the recoil connector and the baseplate body.

Example 9 includes the subject matter of Example 8, and further comprises a bolt/carrier assembly operatively coupled to the recoil connector, the bolt/carrier assembly including a bolt carrier and a bolt; and a charging handle having an elongated body, a handle on a proximal end portion of the elongated body, and a latch adjacent the handle, the elongated body configured to be slidably received through the charging handle opening, the latch configured to engage the catch surface on the latch plate, and the distal end portion of the elongated body is configured to engage the recoil connector.

Example 10 is an upper receiver assembly comprising a rifle upper receiver having a receiver body extending longitudinally along a bore axis from a proximal end portion to a distal end portion, the receiver body having a top plate and an open bottom, the receiver body defining a bolt aperture along the bore axis, a recoil aperture above the bolt aperture, and a charging handle aperture between the recoil aperture and the top plate; and a recoil baseplate received in the recoil aperture, the recoil baseplate having a baseplate body sized and shaped to be received in the recoil aperture and defining an opening extending into the baseplate body along the bore axis, the recoil baseplate further including a latch plate extending up from a top of the baseplate body and defining a catch surface, wherein the latch plate defines a charging handle opening that is axially aligned with the charging handle aperture in the receiver body.

Example 11 includes the subject matter of Example 10, wherein the latch plate includes walls extending up from the top of the baseplate body, the walls aligned along the bore axis and having a laterally spaced-apart arrangement, an outer face of one or both of the walls defining the catch surface.

Example 12 includes the subject matter of any of Examples 10 or 11, and further comprises at least one guide rod extending axially from a proximal end portion to a distal end portion, the proximal end portion received in the recoil baseplate; a recoil connector slidably mounted on the at least one guide rod; and a recoil spring on the at least one guide rod between the recoil connector and the baseplate body.

Example 13 includes the subject matter of Example 12, and further comprises a bolt/carrier assembly operatively coupled to the recoil connector, the bolt/carrier assembly including a bolt carrier and a bolt; and a charging handle that includes an elongated body, a handle on a proximal end of the elongated body, and a latch adjacent the handle, the elongated body slidably received in the channel and the charging handle aperture, wherein the latch is configured to engage the catch surface on the latch plate.

Example 14 includes the subject matter of any of Examples 10-13, and further comprises a barrel assembly secured to the distal end portion of the receiver body, the barrel assembly including a barrel with a gas block.

Example 15 includes the subject matter of Example 14, further comprising an operational rod operatively coupled to the gas block and to the recoil connector.

Example 16 is a firearm comprising the upper receiver assembly of any of Examples 10-15, the firearm is selected from a semiautomatic rifle and an automatic rifle.

Example 17 includes the subject matter of Example 16, and further comprises a lower receiver removably attached to the rifle upper receiver; and a barrel assembly secured to the distal end portion of the receiver body, the barrel assembly including a barrel and a gas block.

Example 18 is a firearm comprising a lower receiver oriented along a central axis, the lower receiver having a lower receiver body and a rear end portion extending upward from the lower receiver body; an upper receiver assembled with the lower receiver and extending along the central axis over the lower receiver, the upper receiver defining a bolt aperture, a recoil aperture above the bolt aperture, and a charging handle aperture above the recoil aperture; a barrel assembly connected to a distal end of the upper receiver, the barrel assembly including a barrel, a gas block on the barrel, and an operational rod extending proximally from the gas block; a recoil assembly including (i) a recoil baseplate having a baseplate body housed in the recoil aperture of the upper receiver, the baseplate body defining an opening, (ii) a latch plate extending up from the baseplate body and defining a catch surface and a charging handle opening aligned with the charging handle aperture in the upper receiver, (iii) one or more recoil spring guide rods having a proximal end portion received in the opening of the recoil baseplate, (iv) a recoil spring on the one or more recoil spring guide rods, (v) a recoil connector slidably mounted on the one or more recoil spring guide rods such that the recoil spring is between the recoil connector and the recoil baseplate, wherein the recoil connector is operably coupled to the operational rod, in use, and (vi) a bolt carrier and bolt operably coupled to the recoil connector; and a charging handle with an elongated body extending longitudinally along the central axis, the elongated body having a proximal end portion with a handle and a latch, and a distal end portion configured to engage the recoil connector, wherein the elongated body is slidably received in the charging handle opening of the latch plate and in the charging handle aperture in the upper receiver.

Example 19 includes the subject matter of Example 18, wherein the latch plate includes walls extending up from the top of the baseplate body, the walls aligned along the central axis and having a laterally spaced-apart arrangement, an outer face of one or both of the walls defining the catch surface, and a gap between the walls defining the charging handle opening.

Example 20 includes the subject matter of Example 18, wherein the recoil baseplate abuts a forward face of the rear end portion of the lower receiver in use.

The foregoing description of example embodiments has been presented for the purposes of illustration and description. It is not intended to be exhaustive or to limit the present disclosure to the precise forms disclosed. Many modifications and variations are possible in light of the present disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A recoil assembly for a rifle having an upper receiver, the recoil assembly comprising:

a baseplate body extending longitudinally along a central axis from a proximal end to a distal end, the baseplate body defining an opening extending along the central axis and configured to receive an end portion of a recoil spring guide rod; and a latch plate fixedly connected to or formed monolithically with the base plate body, the latch plate extending up from a top of the baseplate body and defining a charging handle opening configured for passage therethrough of a charging handle along the central axis and defining a catch surface configured to engage a latch on the charging handle;

wherein the baseplate body is configured to be received in an aft portion of the upper receiver in use, and wherein the baseplate body and latch plate are selectively removable from the upper receiver.

2. The recoil assembly of claim 1, wherein the latch plate comprises laterally spaced-apart walls aligned along the central axis, wherein the charging handle opening is between the laterally spaced-apart walls and the catch surface is defined in a lateral face of one or both of the laterally spaced-apart walls.

3. The recoil assembly of claim 2, wherein the laterally spaced-apart walls include a first wall on a first side of the central axis and a second wall on a second side of the central axis.

4. The recoil assembly of claim 3, wherein the first wall is spaced from the second wall by a gap of 0.3 to 0.5 inch.

5. The recoil assembly of claim 4, comprising a lateral wall extending between and connecting lower portions of the first wall and the second wall, a vertical height of the lateral wall being less than a vertical height of the first wall and the second wall.

6. The recoil assembly of claim 3, wherein an outside face of the first wall defines a first catch surface and an outside face of the second wall defines a second catch surface.

7. The recoil assembly of claim 1, comprising a protrusion extending distally from the latch plate.

8. The recoil assembly of claim 1, further comprising:

at least one guide rod extending axially from a proximal end portion to a distal end portion, the proximal end portion received in the opening of the baseplate body;

a recoil connector slidably mounted on the at least one guide rod; and a recoil spring on the at least one guide rod between the recoil connector and the baseplate body.

9. The recoil assembly of claim 8, further comprising:

a bolt carrier assembly operatively coupled to the recoil connector, the bolt carrier assembly including a bolt carrier and a bolt; and a charging handle having an elongated body, a handle on a proximal end portion of the elongated body, and a latch adjacent the handle, the elongated body configured to be slidably received through the charging handle opening, the latch configured to engage the catch surface on the latch plate, and the distal end portion of the elongated body is configured to engage the recoil connector.

10. An upper receiver assembly comprising:

a rifle upper receiver having a receiver body extending longitudinally along a bore axis from a proximal end portion to a distal end portion, the receiver body having a top plate and an open bottom, the receiver body defining a bolt aperture along the bore axis, a recoil aperture above the bolt aperture, and a charging handle aperture between the recoil aperture and the top plate; and a recoil baseplate received in the recoil aperture, the recoil baseplate having a baseplate body sized and shaped to be received in the recoil aperture and defining an opening extending into the baseplate body along the bore axis, the recoil baseplate further including a latch plate extending up from a top of the baseplate body and defining a catch surface, wherein the latch plate defines a charging handle opening that is axially aligned with the charging handle aperture in the receiver body.

11. The upper receiver assembly of claim 10, wherein the latch plate includes walls extending up from the top of the baseplate body, the walls aligned along the bore axis and having a laterally spaced-apart arrangement, an outer face of one or both of the walls defining the catch surface.

12. The upper receiver assembly of claim 10, further comprising at least one guide rod extending axially from a proximal end portion to a distal end portion, the proximal end portion received in the recoil baseplate;

a recoil connector slidably mounted on the at least one guide rod; and a recoil spring on the at least one guide rod between the recoil connector and the baseplate body.

13. The upper receiver assembly of claim 12, further comprising:

a bolt carrier assembly operatively coupled to the recoil connector, the bolt carrier assembly including a bolt carrier and a bolt; and a charging handle that includes an elongated body, a handle on a proximal end of the elongated body, and a latch adjacent the handle, the elongated body slidably received in the channel and the charging handle aperture, wherein the latch is configured to engage the catch surface on the latch plate.

14. The upper receiver assembly of claim 13, further comprising a barrel assembly secured to the distal end portion of the receiver body, the barrel assembly including a barrel with a gas block.

15. The upper receiver assembly of claim 14, further comprising an operational rod operatively coupled to the gas block and to the recoil connector.

16. A firearm comprising the upper receiver assembly of claim 10, the firearm is selected from a semiautomatic rifle and an automatic rifle.

17. The firearm of claim 16, further comprising:

a lower receiver removably attached to the rifle upper receiver; and a barrel assembly secured to the distal end portion of the receiver body, the barrel assembly including a barrel and a gas block.

18. A firearm comprising:

a lower receiver oriented along a central axis, the lower receiver having a lower receiver body and a rear end portion extending upward from the lower receiver body;

an upper receiver assembled with the lower receiver and extending along the central axis over the lower receiver, the upper receiver defining a bolt aperture, a recoil aperture above the bolt aperture, and a charging handle aperture above the recoil aperture;

a barrel assembly connected to a distal end of the upper receiver, the barrel assembly including a barrel, a gas block on the barrel, and an operational rod extending proximally from the gas block;

a recoil assembly including a recoil baseplate having a baseplate body housed in the recoil aperture of the upper receiver, the baseplate body defining an opening;

a latch plate extending up from the baseplate body and defining a catch surface and a charging handle opening aligned with the charging handle aperture in the upper receiver;

one or more recoil spring guide rods having a proximal end portion received in the opening of the recoil baseplate;

a recoil spring on the one or more recoil spring guide rods;

a recoil connector slidably mounted on the one or more recoil spring guide rods such that the recoil spring is between the recoil connector and the recoil baseplate, wherein the recoil connector is operably coupled to the operational rod, in use; and a bolt carrier and bolt operably coupled to the recoil connector; and a charging handle with an elongated body extending longitudinally along the central axis, the elongated body having a proximal end portion with a handle and a latch, and a distal end portion configured to engage the recoil connector, wherein the elongated body is slidably received in the charging handle opening of the latch plate and in the charging handle aperture in the upper receiver.

19. The firearm of claim 18, wherein the latch plate includes walls extending up from the top of the baseplate body, the walls aligned along the central axis and having a laterally spaced-apart arrangement, an outer face of one or both of the walls defining the catch surface, and a gap between the walls defining the charging handle opening.

20. The firearm of claim 18, wherein the recoil baseplate abuts a forward face of the rear end portion of the lower receiver.

* * * * *